US006132321A

United States Patent [19]

Wethered

[11] Patent Number: 6,132,321

[45] **Date of Patent: *Oct. 17, 2000**

[54] CUE STICK JOINT AND INTERCHANGEABLE CUE

[76] Inventor: William Wethered, 602 NE. Blair Rd., Washougal, Wash. 98671

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,108

[22] Filed: Jul. 17, 1997

Related U.S. Application Data

[60] Provisional application No. 60/022,140, Jul. 17, 1996.

[51] Int. Cl.[7] ..... A63B 59/00

[52] U.S. Cl. ..... 473/47

[58] Field of Search ..... 473/44, 45, 46, 473/47, 48, 49

[56] References Cited

U.S. PATENT DOCUMENTS

| | | | |
|---|---|---|---|
| 608,457 | 8/1898 | Hutzel | 473/47 |
| 970,182 | 9/1910 | Bloom et al. . | |
| 1,007,668 | 11/1911 | Barrows | 473/44 |
| 1,287,215 | 12/1918 | Campbell . | |
| 1,679,073 | 7/1928 | Carmichael . | |
| 1,907,960 | 5/1933 | Guillet . | |
| 3,232,613 | 2/1966 | Laube | 473/47 |
| 3,269,730 | 8/1966 | Miller et al. | 273/68 |
| 3,372,932 | 3/1968 | Molis | 473/47 |
| 3,495,826 | 2/1970 | Mizgala | 473/45 |
| 4,440,391 | 4/1984 | Saenz et al. | 272/93 |
| 5,334,101 | 8/1994 | McDermott | 473/44 |
| 5,407,197 | 4/1995 | Parsons | 473/46 |
| 5,749,788 | 5/1998 | Bourque | 473/44 |

FOREIGN PATENT DOCUMENTS

2192800 A 1/1988 United Kingdom .

*Primary Examiner*—Jeanette Chapman
*Assistant Examiner*—M. Chambers
*Attorney, Agent, or Firm*—R. Reams Goodloe, Jr.

[57] ABSTRACT

A joint system for cue sticks. The system includes a joining member, a sleeve, and a receiving member. The cue stick shaft is prepared by drilling and tapping therein a centered threaded bore extending inwardly along a longitudinal axis from a center end face which is transverse to the longitudinal axis. The cue stick handle is similarly prepared. The joining member is preferably integrally formed or machined from a single solid part, and includes a pin portion and a smaller stud portion with a transverse oriented transition portion therebetween preferably shaped as an annular face portion. The pin portion has an externally threaded engagement portion adapted to securely locate the joining member, in the threaded bore in the cue stick shaft. The stud portion extends along the longitudinal axis outward from the pin portion, and has, at the distal end, a threaded locking portion. A receiving member is provided to receive the stud portion. The receiving member has an open ended barrel portion with a bottom end having therein a threaded bore to receive the threaded locking portion of the stud portion. To absorb shock and to provide for compressive locking engagement, a flanged tubular plastic sleeve is provided between the outer surface of the stud portion and the inner surface of the barrel portion.

17 Claims, 2 Drawing Sheets

CUE STICK JOINT AND INTERCHANGEABLE CUE

This application claims the benefit of U.S. Provisional Application No. 60/022,140 filing date Jul. 17, 1996.

FIELD OF THE INVENTION

My invention relates to a system for joining portions of a cue stick, and more particularly, to a system of parts which provides a means to join cue stick shafts with cue stick handles into a reliable, trouble free cue.

BACKGROUND

It is often desirable to join cue handles and cue sticks shafts, for example, so that the favorite handle is continually used with various shaft portions as necessary. Also, it may be desirable to provide different lengths of cue stick shafts.

To date, various machine parts have been provided in an attempt to enable users to reliably join cue handles and cue stick shafts. Nonetheless, such systems which are known to me have various drawbacks, and are generally susceptible to certain problems, including inadequate strength in the joint, and a resulting tendency to split the cue stick shaft or the cue handle when used for a shot where high compressive forces are applied, such as a break shot. Other systems are sufficiently complicated that it is difficult to provide the parts inexpensively enough to interest large segments of the market for such devices. As a consequence, it is still desirable to improve upon the apparatus and upon the methods which have been used heretofore for joining cue stick shafts with cue stick handles.

SUMMARY

I have now developed a novel, improved joint system for detachably joining a cue stick shaft and a cue stick handle. The system hardware includes a joining member, a sleeve, and a receiving member. To employ the system hardware, the cue stick shaft is prepared by drilling and tapping therein a centered threaded bore extending inwardly along a longitudinal axis from a center end face which is transverse to the longitudinal axis. The cue stick handle is similarly prepared by drilling and tapping therein a centered threaded bore extending inwardly along a longitudinal axis, from a center end face transverse to the longitudinal axis. The joining member is preferably integrally formed or machined from a single solid part, and includes a pin portion and a smaller stud portion with a transverse oriented transition portion therebetween preferably shaped as an annular face portion. The pin portion has an externally threaded engagement portion adapted to securely locate the joining member, via the threaded engagement portion, in the axially located threaded bore in the cue stick shaft. The stud portion extends along the longitudinal axis from the pin portion, said stud portion further comprising a threaded locking portion at the distal end thereof. A receiving member is provide that has an open ended barrel portion with a bottom end that has a partial central threaded bore adapted for receiving in threaded locking engagement the threaded locking portion of the stud portion. To absorb shock and to provide for compressive locking engagement, a preferably annular tube-like sleeve is provided to fit between the outer surface of the stud portion and the inner surface of the barrel portion. The sleeve also has, at its outer end, a flanged first end portion adapted to be compressed between the transition portion and the outer end surface of the handle, when the joint system is assembled to detachably join a cue stick shaft and a cue stick handle in secure, firm engagement.

OBJECTS, ADVANTAGES, AND NOVEL FEATURES

I have now invented, and disclose herein, a novel system for providing a cue stick joint, and which does not have the drawbacks common to those somewhat similar products heretofore used of which I am aware. Unlike the earlier designs, my product is simple, lightweight, relatively inexpensive and easy to manufacture, and otherwise superior to those designs heretofore used or proposed. In addition, it provides a significant, additional measure of ease in interchanging various cue stick shaft portions with cue stick handle portions.

From the foregoing, it will be apparent to the reader that one important and primary object of the present invention resides in the provision of a novel system for joining cue stick handle and shaft portions.

Other important but more specific objects of the invention reside in the provision of a simple joint system for cue sticks as described herein which:

- provide a strong joint for joining the cue stick shaft portion to the cue stick handle portion which does not transmit compressive strain in a fashion which tends to deform or split either the shaft or handle portion;
- can be repeatedly secured and removed without breaking the bond between the cue handle and the joining member, or the bond between the cue shaft and the receiving member.
- can be manufactured in a simple, straightforward manner of strong, resilient, breakage resistant materials;
- in conjunction with the preceding object, have the advantage that they can be quickly and easily manufactured to quickly provide a reliable interchangeable joint system; and
- in a relatively inexpensive manner can be used to improve the speed and efficiency of interchanging cue stick shaft portions with cue stick handle portions.
- allows complete allignment of parts before threaded engagement is begun, so as to avoid cross-threading as is often encountered in prior art devices;

Other important objects, features, and additional advantages of my invention will become apparent to the reader from the foregoing and as the ensuing detailed description and discussion proceeds in conjunction with the accompanying drawing.

DESCRIPTION

Figure 1:
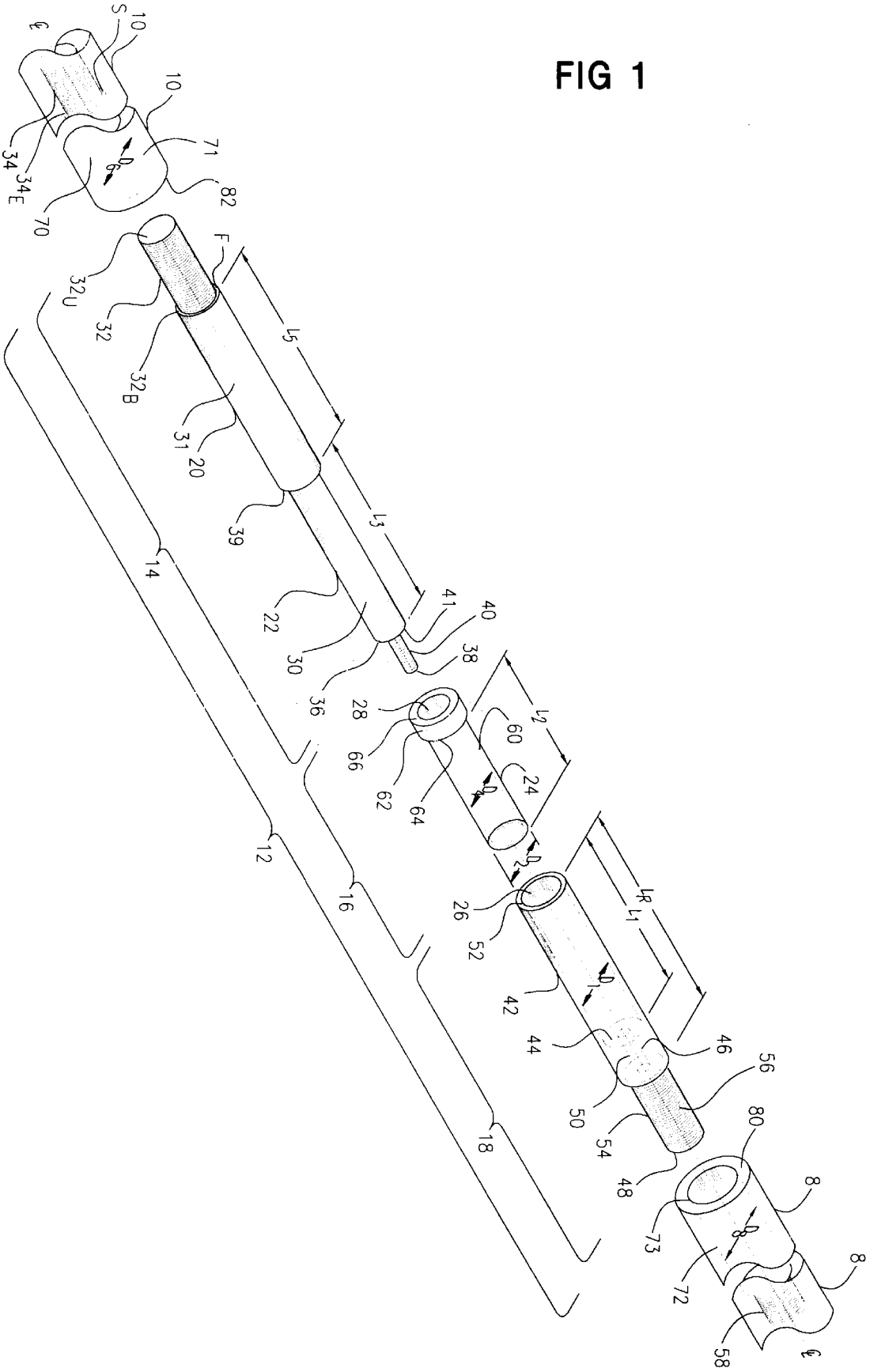
FIG. 1 is an exploded perspective view of my novel cue stick interchangeable joint system.

Attention is directed to FIG. 1 of the drawing wherein my novel joint for detachably and securely joining cue sticks is depicted. The cue stick handle portion 8 and the cue stick shaft portion 10 have positioned therebetween the hardware used in my joint system 12. Specifically, the joint system 12 hardware includes a joining member 14, a sleeve 16, and a receiving member 18. Joining member 14, preferably provided in integral, one-piece construction, has a pin portion 20 for insertion into the cue stick shaft portion 10, and a stud portion 22 for insertion into the cue stick handle portion 8.

Sleeve 16 has an outer surface portion 24 which snugly interfaces with the inside surface 26 of receiving member 18. Sleeve 16 also has an inner surface portion 28 which snugly interfaces with the outer surface 30 of stud portion 22 of the joining member 14. Preferably, outer surface 30 of stud portion 32 and outer surface 31 of pin portion 20 are cylindrical.

Pin portion 20 has a threaded engagement portion 32 (with upper end $\mathbf{32}_U$) which is adapted to be securely located in firm meshing engagement in an axially located threaded bore 34 in the cue stick shaft 10. Ideally, annular face F, located at the base $\mathbf{32}_B$ of threaded engagement portion 32, is provided oriented perpendicular to the longitudinal axis (along $C_L$) of joining member 14. Face F seats against complementary shelf S at the outer end $\mathbf{34}_E$ of bore 34.

The stud portion 22 is preferably integrally formed with and extends from the pin portion 20 of the joining member 14. At the distal end 36 of the stud portion 22, a first threaded locking portion 38 with external threads 40 extends yet further outward. A transition portion between the pin portion 20 and the stud portion 22 is defined by an annular face portion 39 (better seen in FIG. 2) on the pin portion 20. A transition portion between the stud portion 22 and the first threaded locking portion 38 is defined by annular face portion 41 on the stud portion 22.

The receiving member 18 has an an open ended barrel portion 42 with an outside length $L_R$. Barrel portion 42 is preferably shaped as the annulus of a cylinder, with an inside surface 26 of diameter $D_1$ and inside length $L_1$. At the bottom end 44 of the open ended barrel portion 42, a central bore 46 extends inward at least partially (if not entirely) toward the interior end 48 of the receiving member 18. The central bore 46 has an interior threaded portion 50 therein. At the outer end of the receiving member 18 is located an outer end surface 52. Also, at its inner end, the receiving member 18 has a threaded engagement portion 54. The threaded engagement portion 54 has exterior threads 56 which are adapted to securely locate the threaded engagement portion 54 in firm meshing engagement in an axially located threaded bore 58 in the cue stick handle 8.

The sleeve 16 is preferably provided in a slightly compressible material such as nylon or TEFLON, or similar plastic or synthetic material. The sleeve 16 has a tubelike body 60 with an outer surface portion 24 of diameter $D_2$ and a length $L_2$. The diameter $D_2$ is roughly equal, i.e., only slightly less, than the inside diameter $D_1$ of receiving member 18, and of sufficiently similar dimension that the outer surface portion 24 of sleeve 16 will fit snugly in close fitting engagement against the interior surface 26 in receiving member 18.

The sleeve 16 also has a flanged first end portion 62. The flanged first end portion 62 has an annular shaped barrel side surface 64, and an an annular shaped pin side surface 66. The flanged first end portion 62 is adapted to be compressed between the annular face portion 39 (located at the transition between the pin portion 20 and stud portion 22 of joining member 14) and the outer end surface 52 of the receiving member 18. This allows a firm, compressive fit when external threads 40 of the threaded locking portion 38 are inserted into and engaged in firm meshing engagement with threaded bore 46 of receiving member 18.

Figure 2:
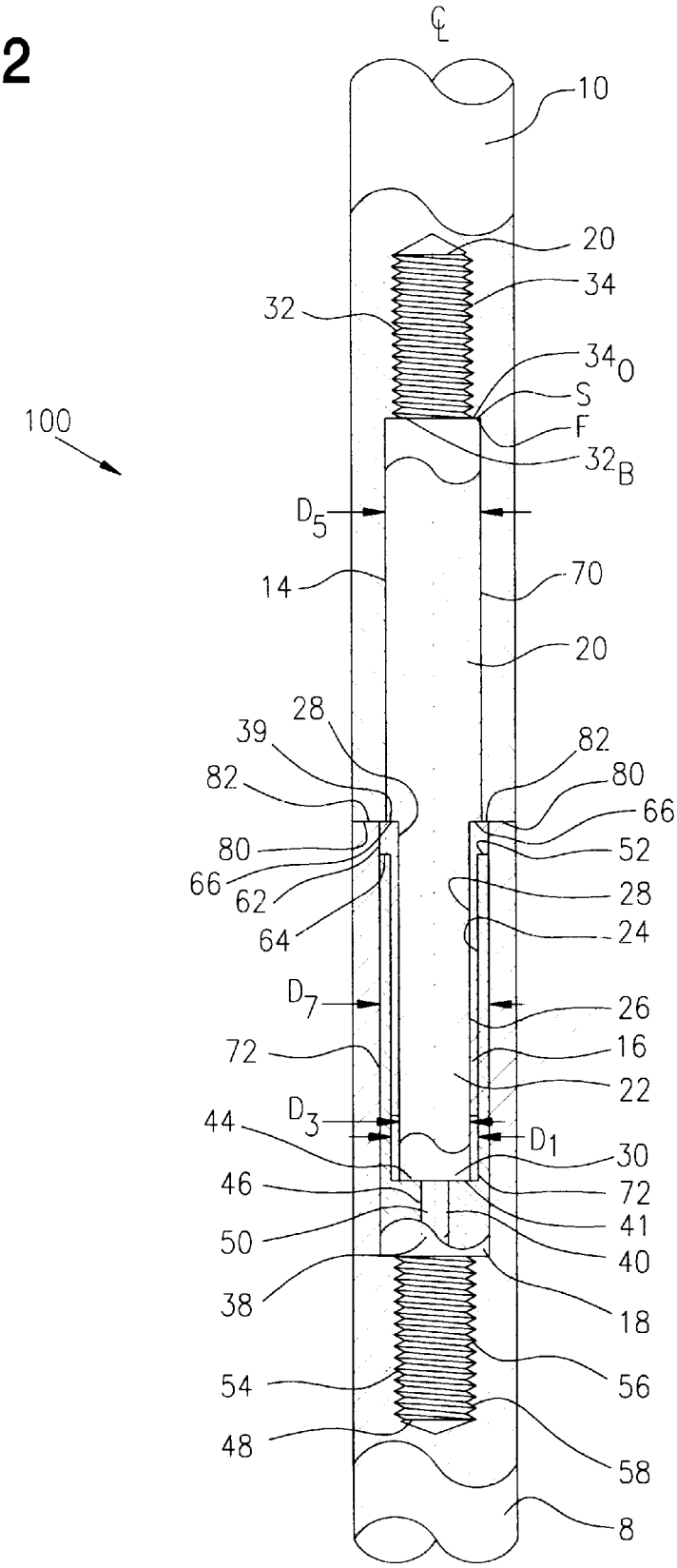
FIG. 2 is a partial cross sectional view of my novel cue stick interchangeable joint system, revealing the working relationship of a joining member, a sleeve, and a receiving member when in use to provide a secure cue stick joint.

Preferably, the stud portion 22 of joining member 14 is provided in a substantially cylindrical shaped shaft of diameter $D_3$ and length $L_3$. The length $L_3$ of the stud portion 22 is sufficient so that the external threads 40 of the threaded locking portion of said stud portion 22 and the interior threaded portion 50 in the central bore of the receiving member 18 are brought into complete axial alignment before threaded engagement is possible. This diameter $D_3$ is roughly equal, i.e., only slightly less, than interior diameter $D_4$ of sleeve 16, and of sufficiently similar dimension that the outer surface 30 of stud portion 22 will fit snugly in close fitting engagement against the interior surface 28 in sleeve 16. This allows compressive forces to further interengage interior surface 28 of sleeve 16 against outer surface 30 of stud 22 when external threads 40 are threadably engaged with interior threaded portion 50 and the resulting assembly is tightened into the closed, secure joint configuration as depicted in FIG. 2. In this manner, the sleeve 16 outer surface portion 24 also is engaged by compressive forces against inner surface 26 of receiving member 18. There is preferably no direct contact between inner surface 26 of receiving member 18 and outer surface 30 of stud portion 22; rather, these parts are separated by a cushion of thickness T by sleeve 16. When sleeve 16 is cylindrical, then thickness T is equal to outer diameter $D_2$ minus inner diameter $D_4$. This cushion of sleeve 16 also serves to minimize or attenuate conduction of noise along the length of the stick, when in use.

It is preferable that the pin portion 20 of joining member 14 be provided in a substantially cylindrical shaped shaft of diameter $D_5$ and length $L_5$, wherein diameter $D_5$ is roughly equal, i.e., only slightly, less than the diameter $D_6$ of axial bore 70 in cue shaft 10. Preferably, length $L_5$ of pin portion 20 is approximately the same, or only slightly less than the length of the smooth surface portion 71 of axial bore 70 in cue shaft 10. Likewise, it is preferable that the receiving member 18 be provided with an exterior diameter $D_7$ (see FIG. 2) which is roughly equal, i.e., only slightly less than the inside diameter $D_8$. Length $L_R$ of receiving member 18 is approximately the same, or only slightly less, than length $L_8$ of the axial bore 72 (starting at end edge 73) in cue handle 8.

FIG. 2 illustrates a cue stick in which cue handle 8 and cue stick shaft 10 are securely joined with my novel joint system 12. It is to be noted that when a joint is tightened into a joined position as illustrated in FIG. 2, a first center end face 80 of cue handle 8 is positioned to be substantially flush, transversely, with the annular shaped pin side 66 of flanged first end portion 62 of sleeve 16. Likewise, the annular shaped surface 39, which forms the transition between the pin portion 20 and the stud portion 22, is positioned to be substantially flush, transversely, with a second center end face 82 of the cue shaft 10. Thus, cue shaft 10 and cue handle 8 are brought into secure, detachable, joining engagement.

For maximum strength, I recommend that the cue handle portion 8 and the joining member 14, be secured each to each other with a suitable high strength glue. Similarly, the cue stick portion 10 and the receiving portion 18 should be secured to each other with a suitable high strength glue. One suitable formulation is a two part epoxy formulation available from J. B. Weld, sold under Universal Product Number 043425826558. This combination of good structural design and high strength bonding provides a secure, strong joint.

It can therefore be appreciated that a method for using my joint system involves simply equipping both cue handles and cue sticks with my novel joint hardware as depicted herein, and then unscrewing the cue stick shaft 10 from a cue handle 8 in an assembled cue stick 100 to disengage one from the other, and then re-engaging desired new cue handle 8' (not shown, but substantially similar to handle S) with the existing cue stick shaft 10 (or vise versa by re-engaging a new cue stick shaft 10', not shown, with the existing cue handle 8) to interlock a desired cue handle 8 and cue stick shaft 10 in firm detachable engagement.

Thus, my novel system provides a joined cue stick 100 which provides for uniform compressive force to avoid splitting of shafts or handles. It also allows easy replacement of damaged or warped cue stick shafts. It is to be appreciated that the novel cue stick joint system disclosed herein is a significant improvement in joints for two piece cue stick systems. My novel replaceable cue stick joint system is relatively simple, and it substantially improves the reliability of joints on two piece billiard and pool cues.

It will thus be seen that the objects set forth above, including those made apparent from the proceeding description, are efficiently attained, and, since certain changes may be made in carrying out the construction of a suitable cue stick joint system, and in providing finished cue sticks employing the same, it is to be understood that the invention may be embodied in other specific forms without departing from the spirit or essential characteristics thereof. For example, while I have set forth an exemplary design for a cue stick joint arrangement, many other embodiments are also feasible to attain the result of the principles of the method disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed.

The intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

I claim:

1. A joint system for detachably securing together a cue stick shaft and a cue stick handle, and said cue stick shaft having a centered threaded bore extending inwardly along a longitudinal axis from a center end face, and said cue stick handle having a centered threaded bore extending inwardly along a longitudinal axis, from a center end face, said joint system comprising:

(a) a joining member, said joining member further comprising
  (i) a pin portion, said pin portion having a threaded engagement portion, said threaded engagement portion adapted to securely locate said threaded engagement portion in said threaded bore in said cue stick shaft;
  (ii) a stud portion, said stud portion extending from said pin portion, said stud portion further comprising a threaded locking portion;
  (iii) a transition portion between said pin portion and said stud portion, said transition portion defined by an annular face portion on said pin portion;

(b) a receiving member, said receiving member further comprising
  (i) an open ended barrel portion, said open ended barrel portion having a
    (A) a bottom end, said bottom end further comprising a partial central bore having an interior threaded portion, and
    (B) an outer end surface at the outer reaches of said open ended barrel portion;
  (ii) a receiving member threaded engagement portion, said receiving member threaded engagement portion having exterior threads adapted to securely locate said receiving member threaded engagement portion in an axially located threaded bore in a cue stick handle; and (c) a sleeve portion, said sleeve comprising an interior tubelike body and a flanged first end portion, said flanged first end portion comprising
  (i) an annular shaped barrel side, and
  (ii) an annular shaped pin side,
  (iii) wherein said flanged first end portion is adapted to be compressed between said transition portion and said outer end surface, when said joint system is assembled to detachably join a cue stick shaft and a cue stick handle in secure, firm engagement.

2. A cue stick, said cue stick comprising in combination:

(a) a cue stick shaft, said cue stick shaft having a handle end face and a threaded bore of diameter $D_1$ therein, centered along the longitudinal axis thereof;

(b) a cue stick handle, said cue stick handle having a shaft end face and a bore of diameter $D_2$ extending axially inward from said shaft end face, and an interior threaded handle end portion; and (c) a joint, said joint comprising
  (i) an integral joining member, said integral joining member further comprising
    (A) a pin portion, said pin portion having a threaded engagement portion, said threaded engagement portion adapted to securely locate said threaded engagement portion in a centrally located threaded bore in said cue stick shaft;
    (B) a stud portion, said stud portion integrally formed with and extending from said pin portion, said stud portion further comprising a threaded locking portion;
    (C) a transition portion between said pin portion and said stud portion, said transition portion defined by an annular face portion on said pin portion;
  (ii) a receiving member, said receiving member further comprising
    (A) an open ended barrel portion having a bottom end, said bottom end comprising at least a partial central bore having an interior threaded portion therein; and
    (B) a barrel threaded engagement portion, said barrel threaded engagement portion having exterior threads adapted to securely locate said barrel threaded engagement portion in a centrally located threaded bore in said cue stick handle; and
  (iii) a sleeve portion, said sleeve comprising an interior tubelike body and a flanged first end portion, said flanged first end portion comprising
    (A) an annular shaped barrel side, and
    (B) an annular shaped pin side,
    (C) wherein said flanged first end portion is adapted to be compressed between said transition portion and said outer end surface of said receiving portion, when said joint is assembled to detachably join said cue stick shaft and said cue stick handle in secure, firm engagement.

3. The device as defined in claim 1, or claim 2, wherein said stud portion comprises a shaft having circular cross section of diameter $D_3$, and wherein said sleeve comprises an inner surface of diameter $D_4$, wherein diameter $D_3$ is approximately equal to diameter $D_4$ along the inner surface of said sleeve.

4. The device as defined in claim 1, or claim 2, wherein said stud portion comprises a substantially cylindrical shaped shaft of diameter $D_3$.

5. The device as defined in claim 1, or claim 2, wherein said sleeve comprises nylon.

6. The device as defined in claim 1, or claim 2, wherein said sleeve comprises polytetraflouroethylene.

7. A joint for detachably securing cue stick shafts and cue stick handles, said joint comprising:

(a) an integral joining member, said integral joining member further comprising
  (i) a pin portion, said pin portion having a threaded engagement portion, said threaded engagement portion adapted to securely locate said threaded engagement portion in an axially located threaded bore in said cue stick shaft;
  (ii) a stud portion, said stud portion integrally formed with and extending from said pin portion, said stud portion further comprising a threaded locking portion;
  (iii) a transition portion between said pin portion and said stud portion, said transition portion defined by an annular face portion on said pin portion;

(b) a receiving member, said receiving member further comprising
  (i) an open ended barrel portion, said open ended barrel portion comprising
    (A) a bottom end, said bottom end further comprising at least a partial central bore having an interior threaded portion therein, and
    (B) an outer end surface at the outer reaches of said open ended barrel portion;
  (ii) a receiving member threaded engagement portion, said receiving member threaded engagement portion having exterior threads adapted to securely locate said receiving member threaded engagement portion in an axially located threaded bore in said cue stick handle; and (c) a sleeve portion, said sleeve comprising an interior tubelike body and a flanged first end portion, said flanged first end portion comprising
  (i) an annular shaped barrel side, and
  (ii) an annular shaped pin side,
  (ii) wherein said flanged first end portion is adapted to be compressed between said transition portion and said outer end surface, when said joint is assembled to detachably join a cue stick shaft and a cue stick handle in secure, firm engagement.

8. A cue stick, said cue stick comprising in combination:

(a) a cue stick shaft, said cue stick shaft having an interior end face with an axial bore of diameter $D_1$ therein, and a interior threaded distal end portion;

(b) a cue stick handle, said cue stick handle having a shaft end face and a bore of diameter $D_2$ extending axially inward from said shaft end face, and an interior threaded handle end portion; and (c) a joint, said joint comprising
  (i) an integral joining member, said integral joining member further comprising
    (A) a pin portion, said pin portion having a threaded engagement portion, said threaded engagement portion adapted to securely locate said threaded engagement portion in a centrally located threaded bore in said cue stick shaft;
    (B) a stud portion, said stud portion integrally formed with and extending from said pin portion, said stud portion further comprising a threaded locking portion;
    (C) a transition portion between said pin portion and said stud portion, said transition portion defined by an annular face portion on said pin portion;
  (ii) a receiving member, said receiving member further comprising
    (A) an open ended barrel portion having a bottom end, said bottom end comprising at least a partial central bore having an interior threaded portion therein; and
    (B) a barrel threaded engagement portion, said barrel threaded engagement portion having exterior threads adapted to securely locate said barrel threaded engagement portion in a centrally located threaded bore in said cue stick handle; and
  (iii) a sleeve portion, said sleeve comprising an interior tubelike body and a flanged first end portion, said flanged first end portion comprising
    (A) an annular shaped barrel side, and
    (B) an annular shaped pin side,
    (C) wherein said flanged first end portion is adapted to be compressed between said transition portion and said outer end surface of said receiving portion, when said joint is assembled to detachably join a cue stick shaft and a cue stick handle in secure, firm engagement.

9. The device as set forth in claim 7 or claim 8, wherein said stud portion comprises a shaft having circular cross section of diameter $D_3$, and wherein said sleeve comprises an inner surface of diameter $D_4$, wherein diameter $D_3$ is approximately equal to diameter $D_4$ along the inner surface of said sleeve.

10. The device as set forth in claim 9, wherein said pin portion has a diameter $D_5$, and wherein said diameter $D_3$ of said stud portion is less than diameter $D_5$ of said pin portion of said joining member.

11. The device as set forth in claim 7 or claim 8, wherein said stud portion comprises a substantially cylindrical shaped shaft of diameter $D_3$.

12. The device as set forth in claim 7 or claim 8, wherein said sleeve comprises nylon.

13. The device as set forth in claim 7 or claim 8, wherein said sleeve comprises polytetraflouroethylene.

14. The device as set forth in claim 7 or claim 8, wherein said sleeve comprises a slightly compressible material.

15. The device as set forth in claim 7 or claim 8, wherein the interior diameter ($D_4$) of said sleeve and the length ($L_3$) of said stud portion is sufficient so that said threaded locking portion of said stud portion and said interior threaded portion in said central bore in said receiving member are brought into complete axial alignment before threaded engagement is possible.

16. The device as set forth in claim 8, wherein said integral joining member is secured to said cue handle by a high strength epoxy glue.

17. The device as set forth in claim 8, wherein said receiving member and said cue stick are joined with a high strength epoxy glue.

* * * * *